United States Patent [19]

Lechtenberg

[11] Patent Number: 4,533,406

[45] Date of Patent: Aug. 6, 1985

[54] MINIMUM ACTIVATION MARTENSITIC ALLOYS FOR SURFACE DISPOSAL AFTER EXPOSURE TO NEUTRON FLUX

[75] Inventor: Thomas Lechtenberg, San Diego, Calif.

[73] Assignee: The United States of America as represented by the United States Department of Energy, Washington, D.C.

[21] Appl. No.: 517,364

[22] Filed: Jul. 26, 1983

[51] Int. Cl.[3] ..... C22C 38/22; C22C 38/24; C22C 38/28

[52] U.S. Cl. ..... 148/37; 75/126 C; 75/126 D; 75/126 E

[58] Field of Search ..... 148/37; 75/126 C, 128 W

[56] References Cited

U.S. PATENT DOCUMENTS

| | | | |
|---|---|---|---|
| 2,188,138 | 1/1940 | Malcolm | 75/126 C |
| 2,199,096 | 4/1940 | Berglund | 75/128 |
| 2,253,385 | 8/1941 | Mahin | 75/128 |
| 2,948,604 | 8/1960 | McFarlane et al. | 75/126 C |
| 3,104,168 | 9/1963 | Bedell, Jr. | 75/126 C |
| 3,201,232 | 8/1965 | Thier | 75/126 C |

*Primary Examiner*—W. Stallard

*Attorney, Agent, or Firm*—Fitch, Even, Tabin & Flannery

[57] ABSTRACT

Steel alloys for long-term exposure to neutron flux have a martensitic microstructure and contain chromium, carbon, tungsten, vanadium and preferably titanium. Activation of the steel is held to within acceptable limits for eventual surface disposal by stringently controlling the impurity levels of Ni, Mo, Cu, N, Co, Nb, Al and Mn.

5 Claims, No Drawings

MINIMUM ACTIVATION MARTENSITIC ALLOYS FOR SURFACE DISPOSAL AFTER EXPOSURE TO NEUTRON FLUX

The present invention relates to steel alloys for use in nuclear reactors and more particularly to a steel alloy which is surface-disposable after long term exposure to a high amount of neutron flux.

BACKGROUND OF THE INVENTION

There exists a need for a high tensile strength steel which when subjected to a high neutron flux over an extended period of time will not swell significantly and which will not become so highly radioactive that it cannot be disposed in surface sites. A particular application for such a steel would be a first-wall or a blanket in a fusion reactor.

Steels currently available which meet the strength and swelling requirements are unsuitable for surface disposal because they have unacceptable levels of elements that transmutate upon neutron bombardment to particularly problematic nuclides, such as those having very long half-lives.

Activated materials require removal to and storage at a remote location whereat the released radiation will have a negligible effect on people or the environment. Currently, the lightwater reactor (LWR) waste guideline, 10 C.F.R. 61, has three classes of waste; classes A, B and C, which are all surface disposal. All others not meeting this are only considered for geologic disposal. All conventional steel alloys will activate such that they would not qualify for surface waste disposal after long-term and/or high level exposure to neutron flux, and would require deep, geologic disposal for many generations because of major constituent elements or levels of impurities too high for surface disposal. All elements will activate upon neutron bombardment, and only a relatively few elements have daughter radionuclides that decay quickly enough or are weak enough such that they could be disposed of as surface waste. The relative costs of disposal methods cannot be estimated easily, but for packaging and burying without monitoring, costs have been recently estimated at $200–600 per cubic foot for any of the three classes of surface waste, and at about $200,000 per cubic foot for the only other alternative, geological disposal.

Wastes represent a potential safety risk in that activated species could be released to the surrounding environment during a reactor accident or, after disposal, by natural deterioration processes. Currently, the most important mechanisms for release of activated nuclides are through lithium or other breeder material fires during normal operating service and by loss of coolant to highly activated material which has its own heating due to radioactive decay, Holdren, J., Science 200:168 (1978). Both mechanisms raise the temperature of the material, potentially resulting in vaporization of activated nuclides. Although high melting point elements have relatively little tendency to volatize, they may form surface oxides which volatize at temperatures well below the melting point of the unoxidized material. From the standpoint of volatization, manganese is particularly undesirable as its major daughter nuclide is another isotope of manganese, $^{54}$Mn, and manganese itself has a relatively high vapor pressure and also forms a volatile oxide.

One solution that has been proposed for eventual disposal of materials subjected to neutron bombardment is "isotopic tailoring" which is the removal of certain naturally occurring isotopes from alloying elements. For example, molybdenum has nine stable occurring isotopes, two of which $^{94}$Mo and $^{95}$Mo capture neutrons, activating to unacceptable radionuclides $^{93m}$Nb and $^{93}$Mo, respectively. Isotopic tailoring would cause $^{94}$Mo and $^{95}$Mo to be removed during isotopic processing such that the dominant radionuclides $^{93m}$Nb and $^{93}$Mo could not be produced. The disadvantages of isotopic tailoring is that an entire industry would have to be created to separate the offending isotopes in every alloying element addition, and this would be an enormous task. Furthermore, residual impurity levels must be very small, and it is not clear that isotopic tailoring on a large scale could produce elements with the required controlled levels of offending isotopes.

Another proposed solution is to use conventional materials, such as AISI 316 austenitic stainless steel, without offending elements, but this also has two disadvantages. The problem of impurity control is also a factor here, and it would be difficult to overcome, although with judicious selection of the alloy system, certain impurities might be minimized. However, this class of steels uses large additions of alloying elements to achieve their "austenitic" characteristics, and because certain alloying element additions may introduce too high levels of impurities, the austenitic class may never achieve the low residual impurity requirement. Furthermore, it is established that austenitic steels increase in volume during exposure to a neutron flux, and swelling of austenitic steels is presently considered to be outside the acceptable design limits for dimension changes in nuclear reactors.

Certain martensitic steels are known which satisfy the strength requirements for use as a first-wall or blanket material for a fusion reactor, and because of its body-centered cubic microstructure, the martensitic form of steel does not tend to swell beyond acceptable limits. Unfortunately, the two common elements used in martensitic steel, molybdenum and nickel, transmutate into daughter nuclides which in the quantities almost certain to be generated, would be highly unacceptable for surface disposal. Molybdenum is used for strength and stability of the microstructure while nickel is used for increased toughness and hardenability (i.e. creating the "martensitic" structure).

Although martensitic steels are known which use substitutes for molybdenum and nickel, simple exclusion of problematic transmutagenic elements from the composition formula is insufficient to render a steel alloy surface-disposable. Impurities in all steels manufactured by known techniques inherently incorporate impurities at levels which would make these materials unsuitable for surface disposal after long-term exposure to neutron flux.

It would be desirable to have a martensitic steel having requisite strength for nuclear reactor use and have sufficiently low concentrations of elements which transmutate into those daughter nuclides for which very low concentrations are permissible for surface-disposal.

SUMMARY OF THE INVENTION

A martensitic steel alloy is provided having a tensile strength suitable for use as a nuclear fusion reactor first-wall or blanket. The steel alloy has controlled amounts of elements which transmutate into nuclides of which extremely low levels are permitted for the steel to be surface-disposable after long-term exposure to neutron flux. In particular, the martensitic steel has no molybdenum or nickel as alloying materials, rather tungsten and vanadium serve in their stead as strengthening alloying material. The steel alloy also contains chromium, carbon and preferably titanium. Elemental impurities, including Ni, Mo, Cu, N, Co, Nb, Al and Mn, are collectively controlled so that the sum of the products of the atom percentage of each element multiplied by a factor for each element, which reflects waste disposal limits of daughter nuclides of the element, is less than a predetermined number, e.g. unity.

DETAILED DESCRIPTION OF THE PREFERRED EMBODIMENT

In accordance with the present invention, a martensitic steel alloy is formulated to include chromium, carbon, tungsten, vanadium and preferably titanium in weight percentages which give the steel alloy a high ultimate tensile strength, making it suitable for uses within a nuclear reactor, such as for a first-wall or a blanket in a fusion reactor. Furthermore, the atom percentages of Ni, Mo, Cu, N, Co, Nb, Al and Mn, which would naturally be incorporated in steel as impurities, are stringently controlled so that even if all of these elements were to transmutate, the totality of daughter nuclides would not emit an unacceptably high level of radiation for surface disposal.

The steel alloy is formulated to have a martensitic microstructure because only martensitic steel has both the ultimate tensile strength required of material for use in a nuclear reactor and sufficient resistance to swelling when exposed to a high neutron flux. For use in a nuclear reactor the ultimate tensile strength should be at least about 400 MPa at room temperature, which for a martensitic steel corresponds to an MPa of 325 to 500° C. (a typical operating temperature for a nuclear reactor). Preferably the ultimate tensile strength is at least about 550 MPa at room temperature which corresponds to an MPa of 475 at 500° C. Because of its body-centered cubic microstructure, martensitic steel will not swell unacceptably when subjected to neutron flux.

Martensitic steels most commonly incoporate molybdenum and nickel as alloying elements because molybdenum and to a lesser extent nickel add strength to the steel by (1) stabilizing carbides with respect to temperature and (2) stabilizing the steel against a partial phase shift to a steel containing some ferrite. A partial phase shift to ferrite may affect not only of strength of the alloy but also its susceptibility to corrosion, radiation damage and swelling. Because both molybdenum and nickel transmutate to daughter nuclides for which very low levels are permissible for surface disposal, both of these materials must be completely eliminated as formulated alloying materials, and substitutions are necessary to effect corresponding strength and phase stabilization.

Tungsten (W) is used in steel alloys of the present invention as a replacement for molybdenum to precipitate and stabilize carbides in the manner of molybdenum, and tungsten is substituted for the molybdenum of similar strength martensitic steels on approximately an equal atom percent basis (approximately a 2 to 1 weight percent basis). Martensitic steel alloys in accordance with the invention include tungsten at levels of between about 2.0 and about 3.0 weight percent.

Steel alloys according to the invention also include vanadium (V) at levels of between about 0.2 and about 0.4 weight percent. Vanadium at these levels increases the strength of the alloy by stabilizing carbides.

To prevent corrosion of the steel, chromium (Cr) is incorporated at relatively high levels, i.e., between about 8.0 and about 12.0 weight percent.

Carbon (C), which is needed to form the carbides of steel, is present at levels of between about 0.1 and about 0.25 weight percent.

It is preferable to use low levels of titanium (Ti) which forms strong carbides, further strengthening the steel and further promoting the shift to the martensitic phase and further stabilizing the carbides. Titanium may be included in the steel alloy at levels up to about 0.2 weight percent.

The elements which are to be avoided, including Cu, N, Co, Nb, Al, and Mn, are, of course, eliminated as formulated alloying substances. Mn is avoided not only because of the radioactive properties of its proscribed daughter nuclide, $^{54}$Mn, but because this nuclide is relatively volatile and forms a volatile oxide. The level of silicon is preferably controlled because indications are that Si forms a silicide with nickel (which may be present as a permissible impurity at a very low level) under neutron irradiation, and the nickel silicide may be a factor in causing irradiation embrittlement. More generally, additional alloying elements are counterindicated because they add to the difficulty of maintaining purity (with respect to proscribed transmutagenic elements) of the steel.

Formulation of a martensitic steel alloy avoiding certain alloying materials is in itself insufficient for making the alloy acceptable for surface waste disposal subsequent to bombardment by neutron flux. If manufactured in accordance with standard steel making procedures, the steel would include unacceptably high collective levels of Ni, Mo, Cu, N, Co, Nb, Al and Mn. Only by stringent control of these elements can a surface-disposable alloy be created. The requisite stringency of control over impurity levels raises the cost of the steel many times above that of steel made without such purity requirements. Thus, although general purpose steels may have been described having formulations that approximate the positive formulations of steels according to the invention, they would be entirely unsuitable for subsequent surface disposal if used in a high neutron flux environment.

In order to meet the goal of surface waste disposal, the martensitic steel has a very low combined level of certain impurities, assuring that the total radiation level of the possible resulting transmutagenic nuclides will be within acceptable limits. Listed in the Table below are the elements which are of concern as impurities, their dominant daughter nuclides and the maximum concentrations in atomic parts per million of each nuclide (if each nuclide were the only nuclide present) to meet the criteria dictated by 10 C.F.R. 61 for Class A, surface-disposable waste.

TABLE

| Element | Dominant Nuclide | Maximum Concentration Appm. 10 yr |
|---|---|---|
| Ni | Co 60 | 1,220 |
| | Fe 55 | 2,550 |
| | Ni 63 | 200 |
| Mo | Mo 93 | 70 |
| | Nb 93m | 190 |
| Cu | Co 60 | 5,250 |
| | Ni 63 | 41 |

TABLE-continued

| Element | Dominant Nuclide | Maximum Concentration Appm. 10 yr |
|---|---|---|
| N | C 14 | 550 |
| Mn | Mn 54 | 60,000 |
| Al | Al 26 | 270,000 |
| Co | Co 60 | 83,000 |
| Nb | Zr 93 | 13,000 |
| | Nb 92 | 260,000 |
| | Nb 94 | 0.1 |

Because none of the elements represents a sole transmutagenic impurity, and therefore, none of the nuclides is the sole problematic nuclide present, the combined levels of the elements must satisfy equation 1 below:

$$\sum_i X_i \eta_i / K_i < 1$$

where $\eta_i$ is the calculated specific activity of impurity element i from the Table, $K_i$ is the allowable activity of impurity element i dictated by 10 C.F.R. 61, and $\lambda_i$ is the volume fraction of impurity element i. This equation says the fraction of allowable radioactivity due to any impurity element times the atomic fraction of that element (in appm) is to be summed over all expected impurity elements, and that the summation must be less than unity.

Using the acceptable levels in the Table and assuming that each element transmutates entirely to the most highly proscribed nuclide, i.e., that having the lowest maximum permissible concentration, the level of impurities must satisfy equation 2:

$$5.14 \times 10^{-3}\chi_{Ni} + 1.43 \times 10^{-2}\chi_{Mo} + 2.45 \times 10^{-2}\chi_{Cu} + 1.8 \times 10^{-3}\chi_{N} + 1.2 \times 10^{-5}\chi_{Co} + 10\chi_{Nb} + 8.44 \times 10^{-3}\chi_{Al} + 1.6 \times 10^{-5}\chi_{Mn} < 1.$$

For class B and C wastes, the numerical constants in the summation would be smaller, thus allowing larger amounts of impurities, but even for class C waste the levels of impurities are very small when compared to conventionally prepared steels.

Transmutagenic elements are controlled by careful selection of very pure materials which are introduced into the steel melt. Very pure materials useful for the present invention may be produced by one or more specialized processes, such as electrolytic refining, vacuum arc remelting, and electron beam processing. Careful selection of ores from which the iron and additives are obtained facilitates obtaining sufficiently pure addities. Each additive to the melt must be analyzed, e.g., by neutron activation analysis or similarly sensitive spectrophotometry to determine the levels of the impurities in the additives to the melt, whereby final impurity levels are generally predetermined. The finished steel must be similarly analyzed to check that the levels of impurities do, in fact, correspond to the impurity levels predicted by calculation.

EXAMPLE

Martensitic steels are formed having the compositions by weight percent listed in Table 1 below.

TABLE 1

| Chromium | Carbon | Tungsten | Vanadium | Titanium | (Iron to 100%) |
|---|---|---|---|---|---|
| 9 | 0.15 | 2.5 | 0.3 | | |
| 9 | 0.15 | 2.5 | 0.3 | 0.1 | |
| 11 | 0.20 | 2.5 | 0.3 | | |
| 11 | 0.20 | 2.5 | 0.3 | 0.1 | |

The above martensitic steel compositions are formulated from ultra-pure metals obtained from Electronic Space Products, Los Angeles. Specifically iron, K-2866 (sponge form), chromium-1361 (pellets), tungsten, K-5413 (powder), vanadium, K-5516A (granular) and titanium, K-5298M (wire form) are used in the heats that prepare the composition listed in Table 1 . Carbon, being non-metallic, generally does not present a significant impurity problem and can be obtained from a number of sources, and herein vapor-deposited carbon is used in the steel forming heats. Table 2 below represents an analysis of the impurities in the above-mentioned metallic components, the levels of the various impurities in parts per million each being less than the number listed.

TABLE 2

| Constituent Alloying Element | Impurity Concentrations | | | | | | | |
|---|---|---|---|---|---|---|---|---|
| | Ni | Mo | Cu | N | Co | Nb | Al | Mn |
| Fe | 20 | 10 | 1 | N.D.* | 20 | N.D. | N.D. | 54 |
| Cr | 2 | 1 | 2 | 10 | N.D. | N.D. | 5 | 2 |
| W | N.D. | 35 | 10 | N.D. | N.D. | N.D. | N.D. | 10 |
| V | 30 | 10 | 10 | N.D. | 10 | N.D. | N.D. | 10 |
| Ti | 1 | 10 | 10 | N.D. | N.D. | N.D. | N.D. | N.D. |

*N.D.: not detected, assume < 1 ppm weight

For the highest alloy, i.e., the alloy at the bottom of Table 1, the total levels of impurities are as follows; Ni<18.3 ppm. Mo<10 ppm, Cu<2 ppm, N<.01 ppm, Co<18 ppm, Nb<0.01 ppm, Al<5 ppm, Mn<5 ppm. Using equation 2 above, the summation totals 0.4284, well below the permissable upper limit of unity. The lower alloys would have somewhat lower summations, and all easily meet the requirements for surface waste disposal.

The steel-forming heats are performed under a vacuum in a vacuum melting furnace suited for high purity melting, such as the furnace at GCA Industries of Cambridge, Mass. Although "pure" raw alloying constituents are used, the metal during melting must be contained. Contamination of the heats is avoided by using a high purity refractory metal crucible or high purity aluminum oxide crucible, such as those which are available from the Sylvania Emmissive Products division of GTE, in Exeter, N.H.

The invention provides a solution to a problem that could probably not be practically solved by previously proposed solutions. Although the process of selecting and analyzing components which go into a martensitic steel melt is expensive, making the steel much more expensive than ordinary steel having a similar positively formulated composition, the solution is by far much less expensive than isotopic separation which has been proposed and is feasible with demonstrated technology. The solution to the surface waste disposal problem preserves the strength of the steel and the martensitic characteristics critical for low swelling, relative to other steels which have been approved for nuclear reactor use, such as HT-9. This would not likely be the case with the use of an austenitic steel as has been proposed, even if transmutagenic impurites in an austenitic steel could be reduced to sufficiently low levels. While the invention has been described in terms of a preferred embodiment, modifications obvious to one with ordinary skill in the art may be made without departing from the scope of the invention. For example, additional alloying additives are permissible, providing they do not raise the levels of proscribed transmutagenic elements. The impurity equation described herein is set for currently imposed U.S. government standards; however, martensitic steels could be produced to meet even more stringent government requirements or to meet requirements propagated by foreign governments.

Various features of the invention are set forth in the following claims:

What is claimed:

1. A steel alloy for long term exposure to a high neutron flux, said steel having a martensitic microstructure and containing between about 8.0 and 12.0 weight percent chromium, between about 0.1 and about 0.25 weight percent carbon, between about 2.2 and about 2.0 weight percent tungsten, and between about 0.2 and about 0.4 weight percent vanadium, and said steel having a controlled amount of Ni, Mo, Cu, N, Co, Nb, Al, and Mn such that $$5.14 \times 10^{-3}\chi_{Ni} + 1.43 \times 10^{-2}\chi_{Mo} + 2.45 \times 10^{-2}\chi_{Cu} + 1.8 \times 10^{-3}\chi_{N} + 1.2 \times 10^{-5}\chi_{Co} + 10\chi_{Nb} + 8.44 \times 10^{-3}\chi_{Al} + 1.6 \times 10^{-5}\chi_{Mn} < 1.$$

2. A steel alloy according to claim 1 wherein the level of Si is below about 0.01 atom percent.

3. A steel alloy according to claim 1 having an ultimate tensile strength of at least about 325 MPa at 500° C.

4. A steel alloy according to claim 1 having an ultimate tensile strength of at least about 475 MPa at 500° C.

5. A steel alloy according to claim 1 also containing titanium at levels up to about 0.2 weight percent.

* * * * *

UNITED STATES PATENT AND TRADEMARK OFFICE

CERTIFICATE OF CORRECTION

PATENT NO. : 4,533,406

DATED : August 6, 1985

INVENTOR(S) : Thomas Lechtenberg

It is certified that error appears in the above-identified patent and that said Letters Patent is hereby corrected as shown below:

Column 3, line 44, change "incoporate" to --incorporate--.

Column 5, line 24, change Greek letter lambda, subscript i "($\lambda_i$)" to Greek letter chi, subscript i --($\chi_i$)--.

Column 5, lines 37-40 and also Column 8, lines 6-9, the formula should read:

$$"5.14 \times 10^{-3}\chi_{Ni} + 1.43 \times 10^{-2}\chi_{Mo} + 2.45 \times 10^{-2}\chi_{Cu} + 1.8 \times 10^{-3}\chi_{N} + 1.2 \times 10^{-5}\chi_{Co} + 10\chi_{Nb} + 8.44 \times 10^{-3}\chi_{Al} + 1.6 \times 10^{-5}\chi_{Mn} < 1".$$

Column 5, lines 56-57, change "addities" to --additives--.

Column 7, line 3, "While" should begin a new paragraph.

Signed and Sealed this

*Third* Day of *December 1985*

[SEAL]

*Attest:*

DONALD J. QUIGG

*Attesting Officer*

*Commissioner of Patents and Trademarks*